US011512513B2

(12) United States Patent
Gasser

(10) Patent No.: US 11,512,513 B2
(45) Date of Patent: Nov. 29, 2022

(54) PIECE OF FURNITURE AND ASSEMBLY FOR USE IN A PIECE OF FURNITURE

(71) Applicant: Julius Blum GmbH, Hoechst (AT)

(72) Inventor: Ingo Gasser, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 618 days.

(21) Appl. No.: 16/576,918

(22) Filed: Sep. 20, 2019

(65) Prior Publication Data

US 2020/0011105 A1 Jan. 9, 2020

Related U.S. Application Data

(63) Continuation of application No. PCT/AT2018/000033, filed on May 4, 2018.

(30) Foreign Application Priority Data

May 11, 2017 (AT) ..... A 50398/2017

(51) Int. Cl.
*E05D 11/00* (2006.01)
*E05D 3/06* (2006.01)
(Continued)

(52) U.S. Cl.
CPC ..... *E05D 11/0054* (2013.01); *E05D 3/06* (2013.01); *E06B 3/88* (2013.01);
(Continued)

(58) Field of Classification Search
CPC ..... E05D 11/0054; E05D 3/06; E05D 3/122; E05D 2011/0072; E05D 15/264;
(Continued)

(56) References Cited

U.S. PATENT DOCUMENTS 3,092,870 A * 6/1963 Baer ..... E06B 3/482 160/206
3,402,422 A * 9/1968 Baer ..... E05D 3/122 16/354
(Continued)

FOREIGN PATENT DOCUMENTS

CN 104420751 3/2015
EP 2 071 108 6/2009
(Continued)

OTHER PUBLICATIONS

International Search Report dated Aug. 23, 2018 in International (PCT) Application No. PCT/AT2018/000033.
(Continued)

*Primary Examiner* — William L Miller
(74) *Attorney, Agent, or Firm* — Wenderoth, Lind & Ponack, L.L.P.

(57) ABSTRACT

An item of furniture includes a first furniture part, a second furniture part, and furniture hinges for pivotally connecting the first furniture part and the second furniture part. The furniture hinges are spaced apart from each other along a longitudinal direction of the first furniture part and the second furniture part, and a gap is defined between the first furniture part and the second furniture part. A cover portion extends at least between the furniture hinges so that the gap can be at least partially covered. The first furniture part and the second furniture part can be moved by the furniture hinges into a position in which the first furniture part and the second furniture part are aligned so as to be substantially coplanar relative to each other whereby the cover portion is substantially covered by the first furniture part and/or the second furniture part.

18 Claims, 6 Drawing Sheets

(51) Int. Cl.
*E06B 3/88* (2006.01)
*E06B 7/36* (2006.01)

(52) U.S. Cl.
CPC ... *E05D 2011/0072* (2013.01); *E05Y 2900/20* (2013.01); *E06B 7/367* (2013.01)

(58) Field of Classification Search
CPC . E05D 15/58; E06B 3/88; E06B 7/367; E05Y 2900/20; E05Y 2800/41; E05Y 2900/212; Y10T 16/533; Y10T 16/541
USPC ..... 160/206, 354; 16/250; 49/398
See application file for complete search history.

(56) References Cited

U.S. PATENT DOCUMENTS 4,679,277 A * 7/1987 Shibata ..... E05D 3/122 16/382
4,856,141 A * 8/1989 Sassenberg ..... E05D 5/08 16/250
4,976,008 A * 12/1990 Baer ..... E05D 3/122 16/354
4,996,739 A * 3/1991 Baer ..... E05D 3/122 384/906
4,999,878 A * 3/1991 Baer ..... E05D 1/04 16/354
5,062,181 A * 11/1991 Bobrowski ..... E05D 3/122 16/234
5,201,902 A * 4/1993 Baer ..... E05D 3/122 16/354
5,337,451 A * 8/1994 Goossens ..... E05D 5/12 16/354
5,991,975 A 11/1999 Baer
9,297,190 B2 3/2016 Lee
9,428,946 B2 8/2016 Martinez Garcia et al.
D854,397 S * 7/2019 Hammerle ..... D8/328
10,337,224 B1 * 7/2019 Shah ..... E05D 11/0018
10,385,598 B2 * 8/2019 Shah ..... E05D 3/122
11,047,158 B2 * 6/2021 Watanabe ..... E05F 1/1215
2006/0150369 A1 * 7/2006 Baer ..... E05D 9/00 16/301
2014/0167583 A1 * 6/2014 Chen ..... E05D 3/122 312/322
2015/0233161 A1 8/2015 Martinez Garcia et al.
2015/0330127 A1 11/2015 Lee
2015/0361699 A1 * 12/2015 Manzoni ..... E05D 11/0054 16/251

FOREIGN PATENT DOCUMENTS

EP 2 450 512 5/2012
EP 2 899 344 7/2015
JP 53-135946 10/1978
JP 03-47380 5/1991
JP 2009-275468 11/2009
JP 5175676 1/2013
KR 10-2012-0041333 5/2012
TW M372879 1/2010
TW M452684 5/2013
WO 99/23337 5/1999

OTHER PUBLICATIONS

Search Report dated Sep. 3, 2020 in corresponding Chinese Patent Application No. 201880028474.3.
Office Action dated Nov. 4, 2020 in corresponding Japanese Patent Application No. 2019-559798, with English Translation.
Decision of Patent Examination with Search Report dated Jul. 25, 2019 in TW Application No. 107114848, with English translation.

* cited by examiner

Fig. 1a
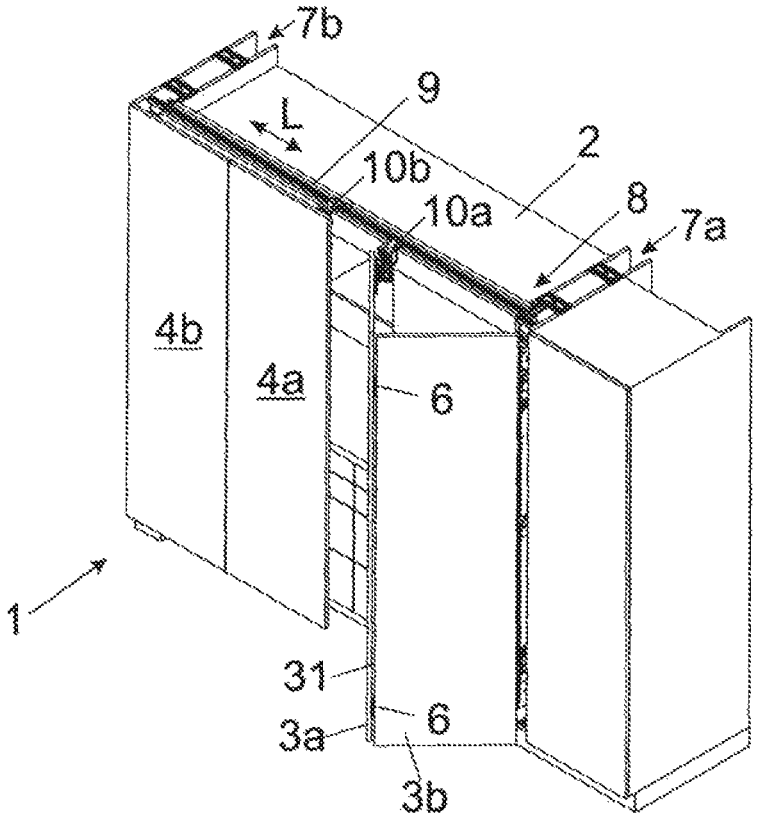
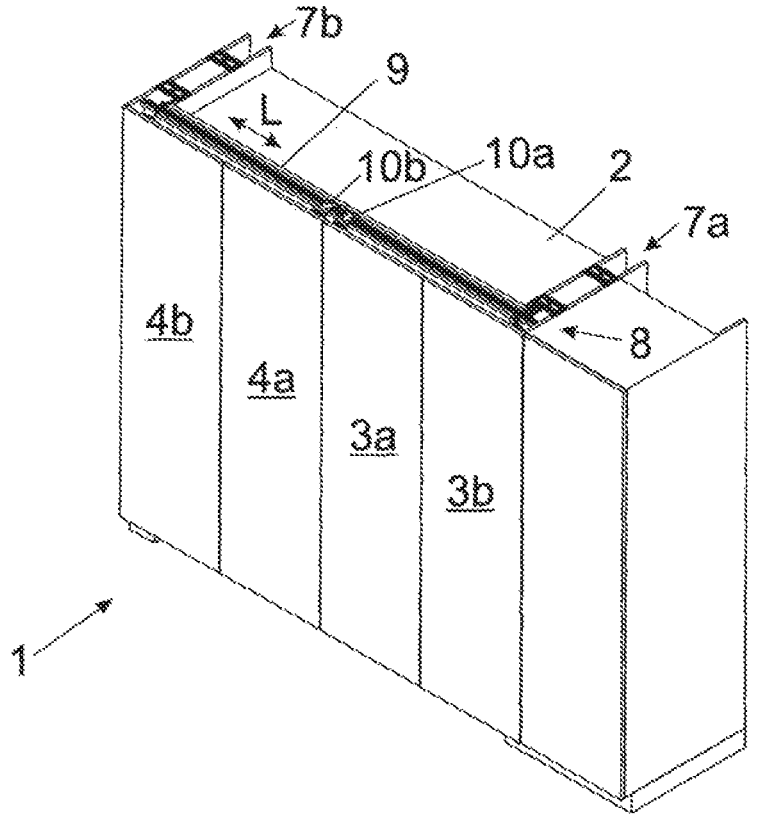
Fig. 1b

Fig. 5a
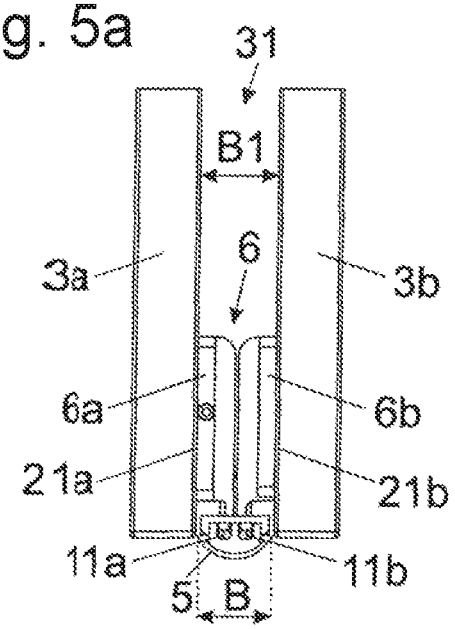
Fig. 5b
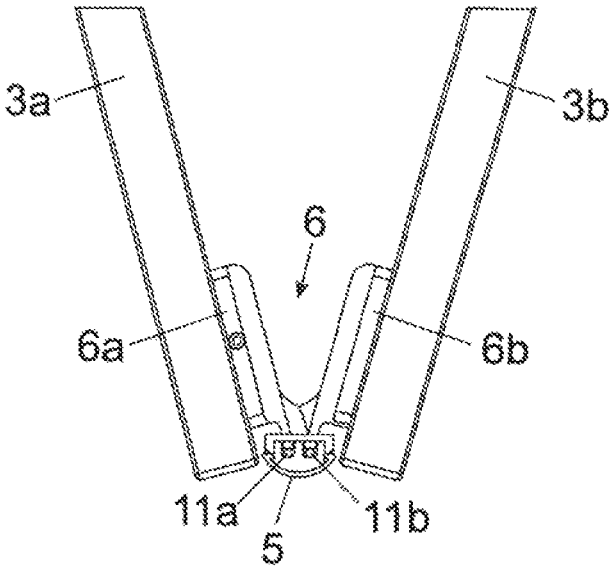
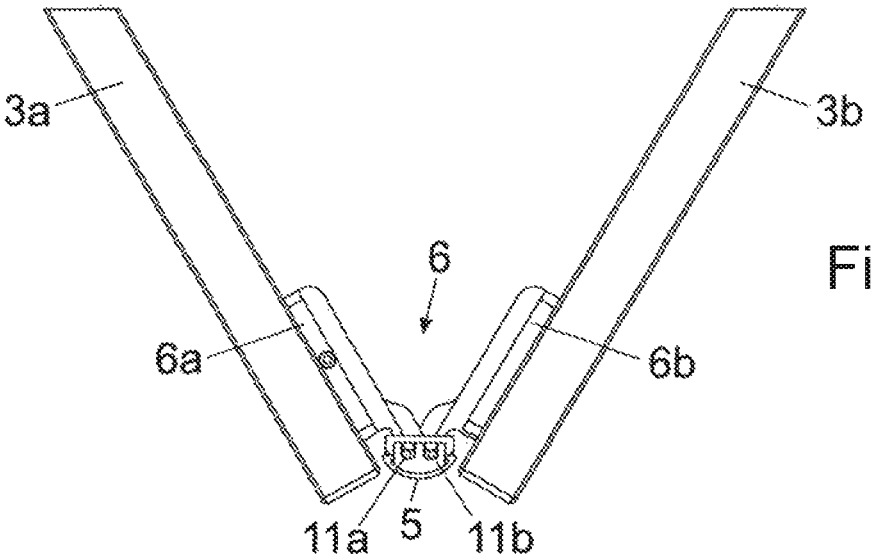
Fig. 5c
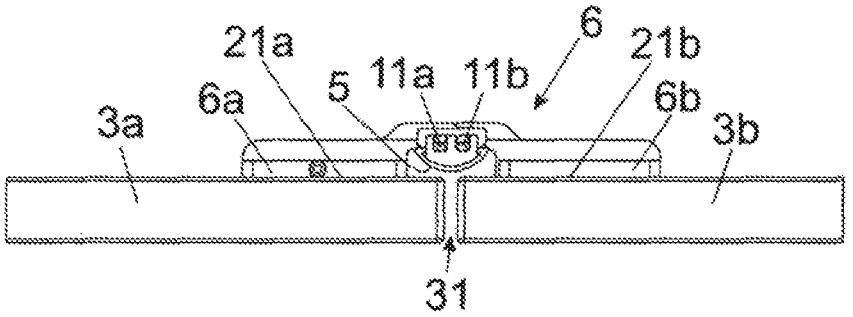
Fig. 5d

PIECE OF FURNITURE AND ASSEMBLY FOR USE IN A PIECE OF FURNITURE

BACKGROUND OF THE INVENTION

The present invention relates to an item of furniture having a first furniture part, a second furniture part and at least two furniture hinges by which the first furniture part and the second furniture part are pivotally connected to one another, wherein the furniture hinges are spaced from each other along a longitudinal direction of the furniture parts, and wherein a gap is formed between the first furniture part and the second furniture part, wherein at least one cover portion is provided which extends at least between the first furniture hinge and the second furniture hinge and by which the gap can be at least partially covered, wherein the first furniture part and the second furniture part can be moved by the at least two furniture hinges into a position in which the first furniture part and the second furniture part are aligned substantially coplanar relative to one another.

Between two furniture parts, which are connected by two or more furniture hinges to one another, a gap can be formed in at least one relative position of the furniture parts, and the gap can cause a painful contusion upon an engagement of fingers and upon a subsequent relative movement of the furniture parts to one another. Moreover, the hinge mechanisms of the furniture hinges can be seen through the gap which does not satisfy the need for esthetics and defined lines. Moreover, the entry of dirt through the gap and into the furniture carcass is enabled.

EP 2 899 344 A1 discloses an arrangement having two furniture hinges spaced from each other and a cover portion. By the cover portion, a gap formed between two door wings connected to the furniture hinges in the mounted position can be covered. The cover portion is coupled to a movement of the furniture hinges, so that the cover portion, in a coplanar position of the door wings relative to one another, is arranged between the door wings. In a parallel position of the door wings, the cover portion is arranged in front of the gap. Accordingly, the cover portion is visible for a person in all operating positions, which is disturbing from an optical perspective. Moreover, there is frequently the desire that the outer gap appearance of the item of furniture is uniform to the gap appearance of adjacent items of furniture, in which the cover portion, which is always visible, may also bother.

SUMMARY OF THE INVENTION

It is an object of the present invention to propose an item of furniture mentioned in the introductory part, in which at least one of the above-discussed drawbacks is avoided.

According to the invention, it is provided that the at least one cover portion, in the coplanar position of the furniture parts, is substantially fully covered by the first furniture part and/or by the second furniture part.

Accordingly, the cover portion in a position, in which the furniture parts are aligned coplanar to one another, is practically invisible for a person. Accordingly, the gap formed between the furniture parts can be dimensioned with a predefined standard size and can be configured so as to be uniform with the gap sizes of adjacent items of furniture.

Moreover, it can be provided that the first furniture part and the second furniture part can be moved by the at least two furniture hinges into a position in which the first furniture part and the second furniture part are aligned substantially parallel to one another, and the at least one cover portion, in the parallel position of the furniture parts, is arranged between the furniture parts. In this way, the cover portion can be configured so as to have a very narrow width and comes very discreet into appearance in the parallel position of the furniture parts.

Thereby, it can be provided that at least one furniture hinge has a hinge axis, and a longitudinal direction of the cover portion extends substantially parallel to the direction of the hinge axis of the furniture hinge.

According to an embodiment, it can be provided that the cover portion is connected or is configured to be, preferably releasably, connected to at least one furniture hinge.

It is also possible that the first furniture part and the second furniture part are pivotally connected to one another by three or more furniture hinges, and the cover portion extends at least between the three or more furniture hinges.

A width of the cover portion can be dimensioned such that the cover portion has a width being less than a width of the largest gap being present.

Protection is also sought for an arrangement to be used for such an item of furniture, and the arrangement comprises a first furniture hinge, a second furniture hinge and a cover portion of the described type.

BRIEF DESCRIPTION OF DRAWINGS

Further details and advantages of the present invention result from the embodiment shown in the drawings, in which:

FIG. 1*a*, 1*b* show an item of furniture having a first furniture part and a second furniture part in an open position and in a closed position, FIG. 5*a*-5*d* show a movement sequence of the furniture parts, starting from a parallel position into a coplanar position to one another.

DETAILED DESCRIPTION OF THE INVENTION

Figure 2A:
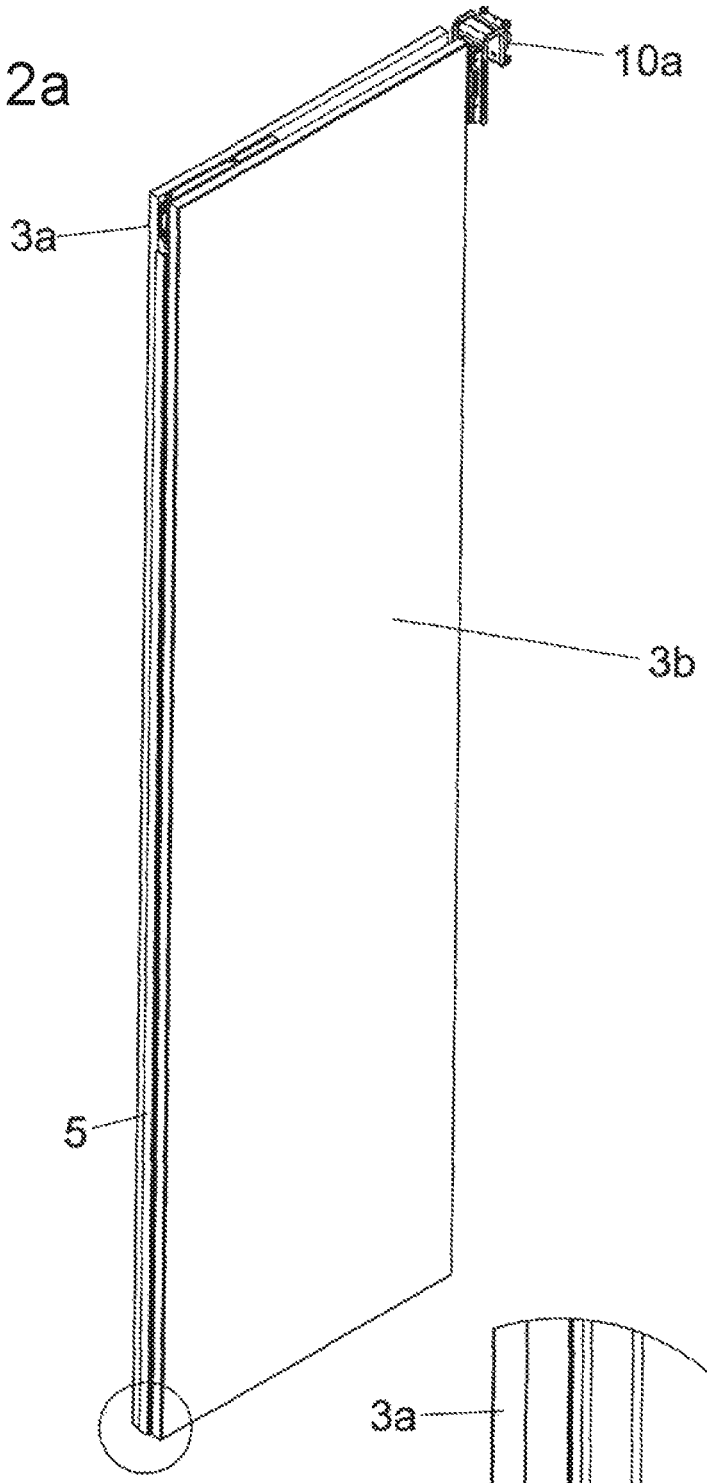
FIG. 2*a*, 2*b* show the furniture parts in a parallel position to one another, and an enlarged detail view thereof.

FIG. 1*a* shows an item of furniture 1 having a furniture carcass 2, in which each of a first furniture part 3*a* and a second furniture part 3*b* can be moved relative to the furniture carcass 2. The first furniture part 3*a* and the second furniture part 3*b* are pivotally connected to one another by at least two furniture hinges 6. However, three or more furniture hinges 6 spaced from each other may be also provided. Furniture hinges 6 which are configured so as to pivotally connect two movably-mounted furniture parts 3*a*, 3*b* are frequently denoted as middle hinges. Moreover, two further furniture parts 4*a*, 4*b* may be provided, and each of the furniture parts 4*a*, 4*b* are also pivotally connected to one another by furniture hinges 6. A vertical gap 31 is formed between the first furniture part 3*a* and the second furniture part 3*b*. The gap 31 can cause serious injuries to persons upon a possible finger engagement, causes a visually disturbing view onto the furniture hinges 6 and facilitates the intrusion of dirt into the furniture carcass 2.

The furniture parts 3*a*, 3*b* and 4*a*, 4*b* are movably supported relative to the furniture carcass 2 by a guide system 8. In the shown embodiment, the furniture parts 3*a*, 3*b*; 4*a*, 4*b* are movably supported by the guide system 8 between a first position, in which the furniture parts 3*a*, 3*b*; 4*a*, 4*b* are aligned substantially parallel to one another, and a second position, in which the furniture parts 3*a*, 3*b*; 4*a*, 4*b* are aligned substantially coplanar to one another (FIG. 1*b*). In the first position, in which the furniture parts 3*a*, 3*b*; 4*a*, 4*b* are aligned parallel to one another, the furniture parts 3*a*, 3*b*; 4*a*, 4*b* can be moved in pairs into a cavity 7*a*, 7*b* arranged laterally besides the furniture carcass 2. The guide system 8 includes a first guide rail 9 having a longitudinal direction (L) for guiding the furniture parts 3*a*, 3*b*; 4*a*, 4*b*. The guide system 8 further includes at least one second guide rail (not visible here), the second guide rail extending at a right angle relative to the longitudinal direction (L) of the first guide rail 9 in the mounted condition and by which each of the furniture parts 3*a*, 3*b*; 4*a*, 4*b* can be inserted into and extended from the lateral cavities 7*a*, 7*b*. The furniture part 3*a* is connected to a guide device 10*a* configured to be displaced along the first guide rail 9. The furniture 4*a*, on the contrary, is connected to a further guide device 10*b* which is also configured to be displaced along the first guide rail 9. FIG. 1*b* shows the furniture parts 3*a*, 3*b*; 4*a*, 4*b* in a closed position in which the furniture parts 3*a*, 3*b*; 4*a*, 4*b* are aligned coplanar to one another.

Figure 2B:
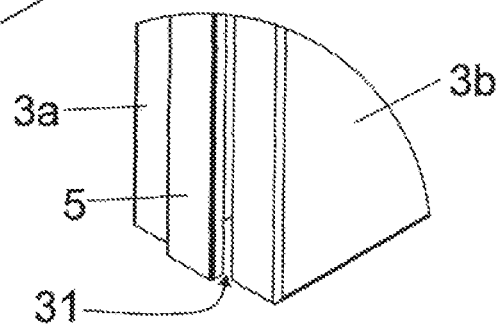

FIG. 2*a* shows a perspective view of the furniture parts 3*a*, 3*b* which, in the shown figure, adopt a parallel position to one another and can thereby be moved into and out from the lateral cavity 7*a* (FIG. 1*a*, 1*b*). Also visible is the guide device 10*a* connected to the first furniture part 3*a*, the guide device 10*a* being configured to be moved along the first guide rail 9. A lengthy gap 31 is formed between the furniture parts 3*a*, 3*b*, and the gap 31 can be at least partially covered by a cover portion 5. The cover portion 5 extends at least between two furniture hinges 6 spaced from each other in a longitudinal direction (H) of the furniture parts 3*a*, 3*b*. FIG. 2*b* shows the region encircled in FIG. 2*a* in an enlarged view, in which the cover portion 5 covers the gap 31 and can thereby protrude at least partially from the narrow sides of the furniture parts 3*a*. The cover portion 5 can be configured as a profiled rail, preferably U-shaped in a cross-section, for example made of metal or plastic.

Figure 3A:
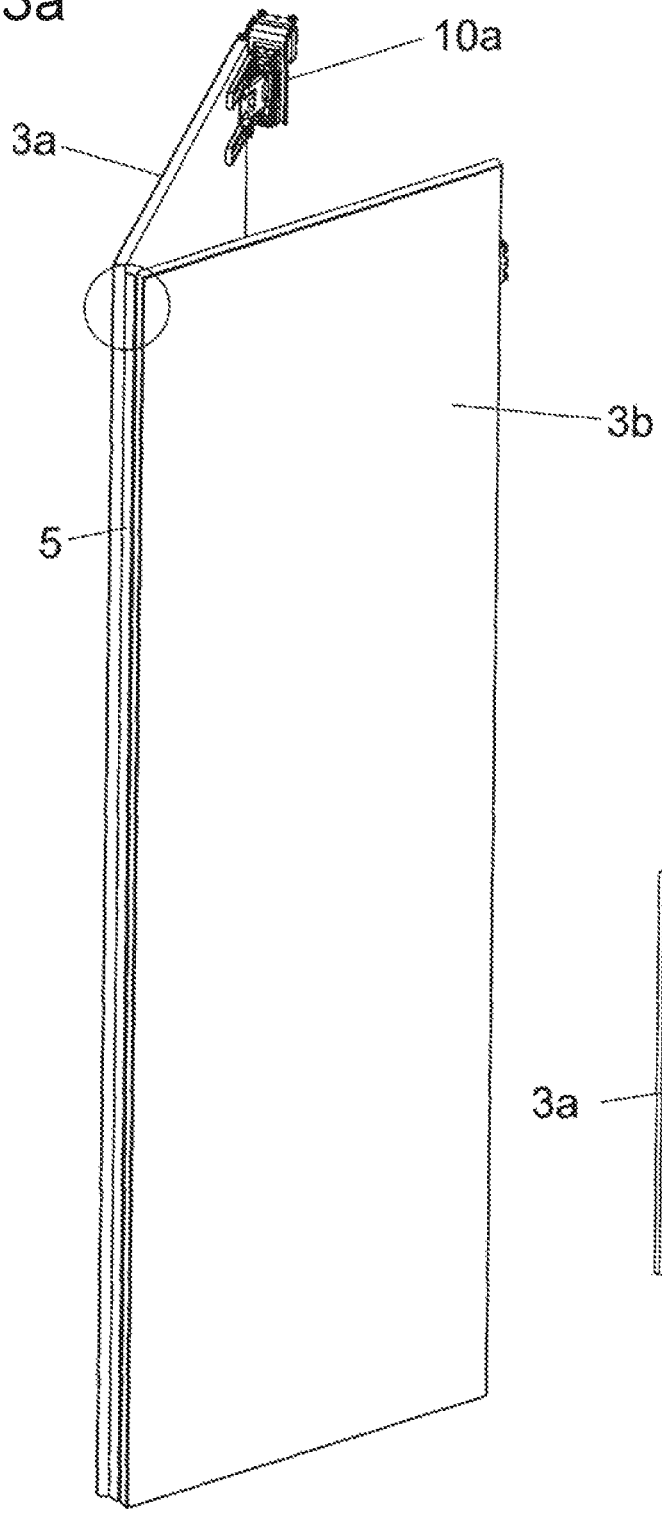
FIG. 3*a*, 3*b* show the furniture in an angled position to one another, and an enlarged detail view thereof.
Figure 3B:
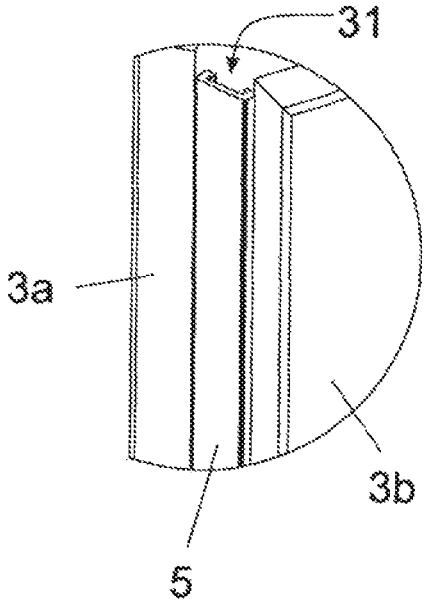

FIG. 3*a* shows the furniture parts 3*a*, 3*b* which adopt an angled position to one another. It is visible that the cover portion 5—starting from the (first) parallel position of the furniture parts 3*a*, 3*b* according to FIG. 2*b* in which the cover portion 5 protrudes over the narrow sides of the furniture parts 3*a*, 3*b*—upon a movement of the furniture parts 3*a*, 3*b* in a direction of the second position in which the furniture parts 3*a*, 3*b* adopt a coplanar position to one another—continually retracts in a direction of a depth of the furniture carcass 2.

Figure 4:
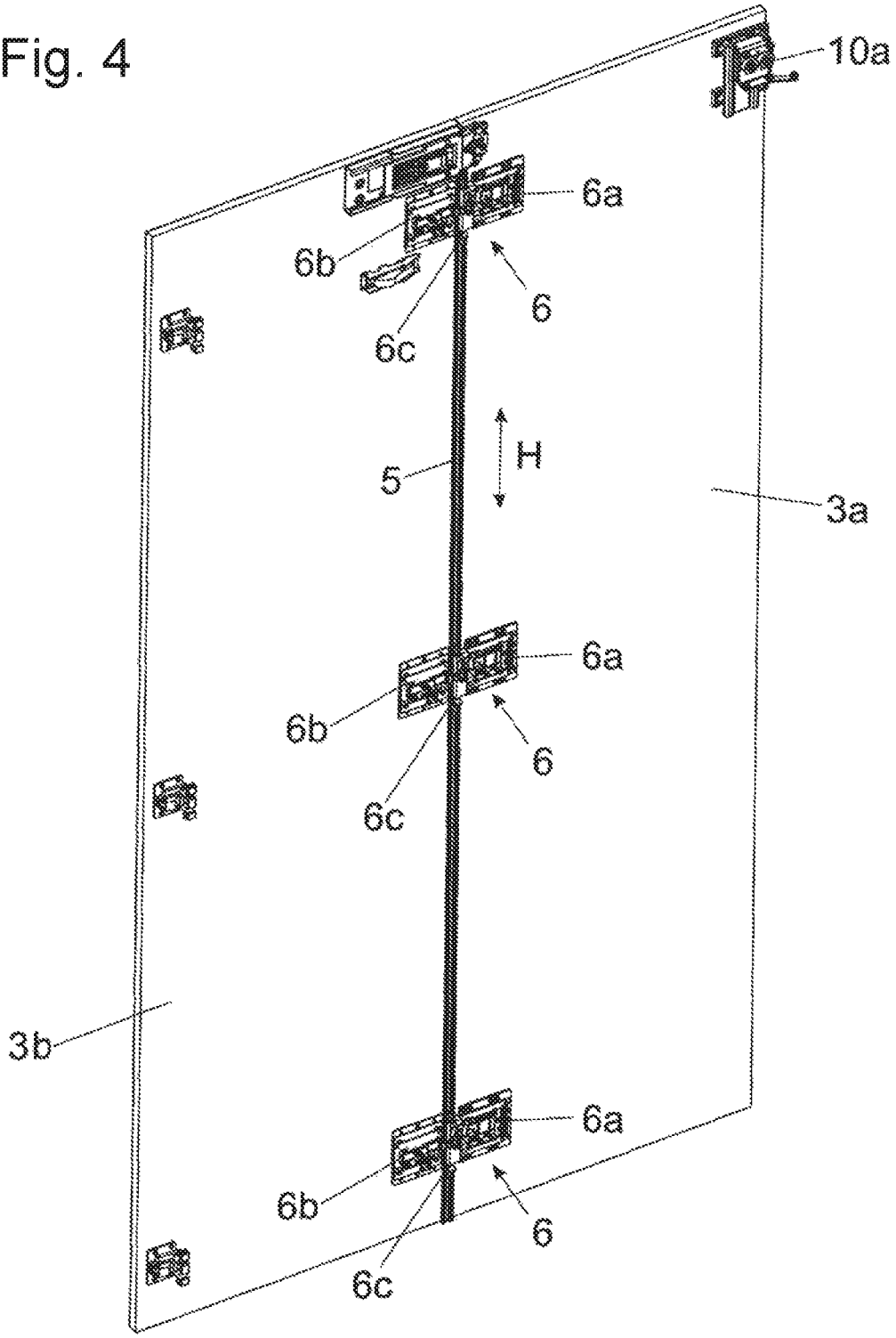
FIG. 4 shows the furniture parts in a coplanar position to one another.

FIG. 4 shows the back side of the two furniture parts 3*a*, 3*b* which, in the shown figure, adopt a coplanar position to one another. The first furniture part 3*a* and the second furniture part 3*b* are pivotally connected to one another by two or more furniture hinges 6, and each of the furniture hinges 6 includes a first fitting portion 6*a* to be fixed to the first furniture part 3*a* and a second fitting portion 6*b* to be fixed to the second furniture part 3*b*. Each of the first fitting portions 6*a* and second fitting portions 6*b* are pivotally connected to one another by at least one hinge axis 6*c*. The furniture hinges 6 are spaced from each other in a longitudinal direction (H) of the furniture parts 3*a*, 3*b*, and the cover portion 5 extends between at least two furniture hinges 6. In the coplanar position of the furniture parts 3*a*, 3*b*, the cover portion 5 is in a retracted position, so that the cover portion 5 is not visible from the front in that relative position of the furniture parts 3*a*, 3*b*.

FIG. 5*a*-5*d* show a movement of the furniture parts 3*a* and 3*b*, starting from a parallel position into a coplanar position to one another. The first fitting portion 6*a* is fixed to the first furniture part 3*a*, the second fitting portion 6*b* is fixed to the second furniture part 3*b*, and the two fitting portions 6*a*, 6*b* are pivotally connected to one another by the hinge axis 6*c* shown in FIG. 4. The cover portion 5 is connected to at least one furniture hinge 6 or, alternatively, is configured to be, preferably releasably, connected to at least one furniture hinge 6. The cover portion 5 can be configured so as to be movable relative to the fitting portions 6*a*, 6*b*, and a movement of the cover portion 5 can be coupled to a relative movement of the fitting portions 6*a*, 6*b* to one another. For controlling a movement of the cover portion 5, the first fitting portion 6*a* includes a first guide pin 11*a* and the second fitting portion 6*b* includes a second guide pin 11*b*. Each of the first guide pin 11*a* and the second guide pin 11*b* are arranged so as to be offset to the hinge axis 6*c* and are each guided with clearance within a recess 20*a*, 20*b* (FIG. 6*b*) of a bearing body 15, the bearing body 15 being connected or being releasable connectable to the cover portion 5. In FIG. 5*a*, the parallel position of the furniture parts 3*a*, 3*b* is shown, in which the cover portion 5 protrudes at least partially over the narrow sides of the furniture parts 3*a*, 3*b*. In the shown embodiment, the cover portion 5 has a curved-shaped or an embossed peripheral surface. When now the furniture parts 3*a* and 3*b* are pivoted relative to one another (FIG. 5*b*), the cover portion 5 is entrained by a relative movement of the fitting portions 6*a*, 6*b*. In a further position of the furniture parts 3*a*, 3*b* to one another (FIG. 5*c*), the cover portion 5 is continually retracted. In the coplanar position of the furniture parts 3*a*, 3*b* (FIG. 5*d*), the cover portion 5 is arranged on a back side of the first furniture part 3*a* and/or on a back side of the second furniture part 3*b*, so that the cover portion 5 is practically invisible from the front in the coplanar position of the furniture parts 3*a*, 3*b*.

The furniture hinges 6 include a first abutment surface 21*a* for resting against the first furniture part 3*a* and a second abutment surface 21*b* for resting against the second furniture part 3*b*, and a width (B) of the at least one cover portion 5, in the parallel position of the furniture parts 3*a*, 3*b* (FIG. 5*a*), is smaller than a distance (B1) formed between the abutment surfaces 21*a*, 21*b* of the furniture hinges 6. In the coplanar position of the furniture parts 3*a*, 3*b* (FIG. 5*d*), the at least one cover portion 5 is arranged so as to be set back relative to the first and second abutment surface 21*a*, 21*b* of the furniture hinges 6.

Figure 6A:
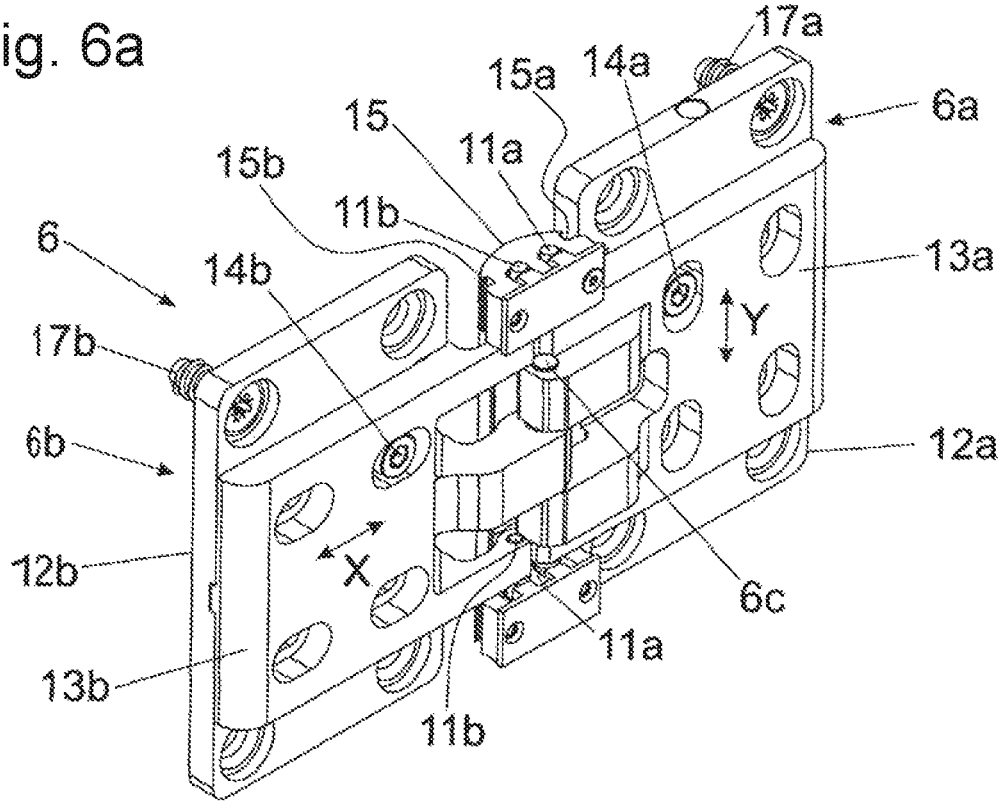
FIG. 6*a*, 6*b* show an embodiment of a furniture hinge in a perspective view and in an exploded view.

FIG. 6*a* shows a perspective view of a furniture hinge 6 which includes a first fitting portion 6*a* to be fixed to the first furniture part 3*a* and a second fitting portion 6*b* to be fixed to the second furniture part 3*b*, and the fitting portions 6*a*, 6*b* are pivotally connected to one another by at least one hinge axis 6*c*. The first fitting portion 6*a* includes a first base plate 12*a* to be fixed to the first furniture part 3*a* by at least one first fastening means 17*a*. A first adjusting plate 13*a* is movably supported on the first base plate 12*a*, and by an actuation of a first adjustment device 14*a*, a position of the first adjusting plate 13*a* can be adjusted, preferably in a vertical direction (Y), relative to the first base plate 12*a*. In this way, the furniture parts 3*a*, 3*b* are adjustable relative to one another in a height direction in a mounted condition. The second fitting portion 6*b* includes a second base plate 12*b* to be fixed to the second furniture part 3*b* by at least one second fastening means 17*b*. A second adjusting plate 13*b* is movably supported on the second base plate 12*b*, and by an actuation of a second adjustment device 14*b*, a position of the second adjusting plate 13*b* can be adjusted, preferably in a lateral direction (X), relative to the second base plate 12*b*. In this way, the furniture parts 3*a*, 3*b* are adjustable relative to one another in a lateral direction in a mounted condition. In the shown figure, each of the adjustment devices 14*a*, 14*b* includes clamping screws configured to be displaced within an elongated hole of the adjusting plates 13*a*, 13*b*. For adjustment purposes, the clamping screws are to be released, the adjustment of the adjusting plates 13*a*, 13*b* relative to the base plates 12*a*, 12*b* to be performed, and, subsequently, the clamping screws are again to be tightened. However, at least one of the adjustment devices 14*a*, 14*b* can have a self-locking configuration, and by an actuation of an adjustment element, a—preferably continuous—adjustment of the adjusting plates 13*a*, 13*b* relative to the base plates 12*a*, 12*b* can be brought about.

The furniture hinge 6 includes a bearing body 15 which is connected or which is configured to be releasably connected to the cover portion 5. Hereby, guides 15*a*, 15*b* can be formed or arranged on the bearing body 15 for example, and the cover portion 5 is configured to be inserted into or is configured to be snapped onto the guides 15*a*, 15*b* of the bearing body 15. Of course, the cover portion 5 can also be fixed to the bearing body 15 by other force-locking or form-locking connections. Arranged on the first adjusting plate 13*a* are upper and lower (first) guide pins 11*a*, while upper and lower (second) guide pins 11*b* are arranged on the second adjusting plate 13*b*. Each of the first and second guide pins 11*a*, 11 *b* engage into a recess 20*a*, 20*b* (FIG. 6*b*) of the bearing body 15 and are guided with clearance within the recesses 20*a*, 20*b* of the bearing body 15.

Figure 6B:
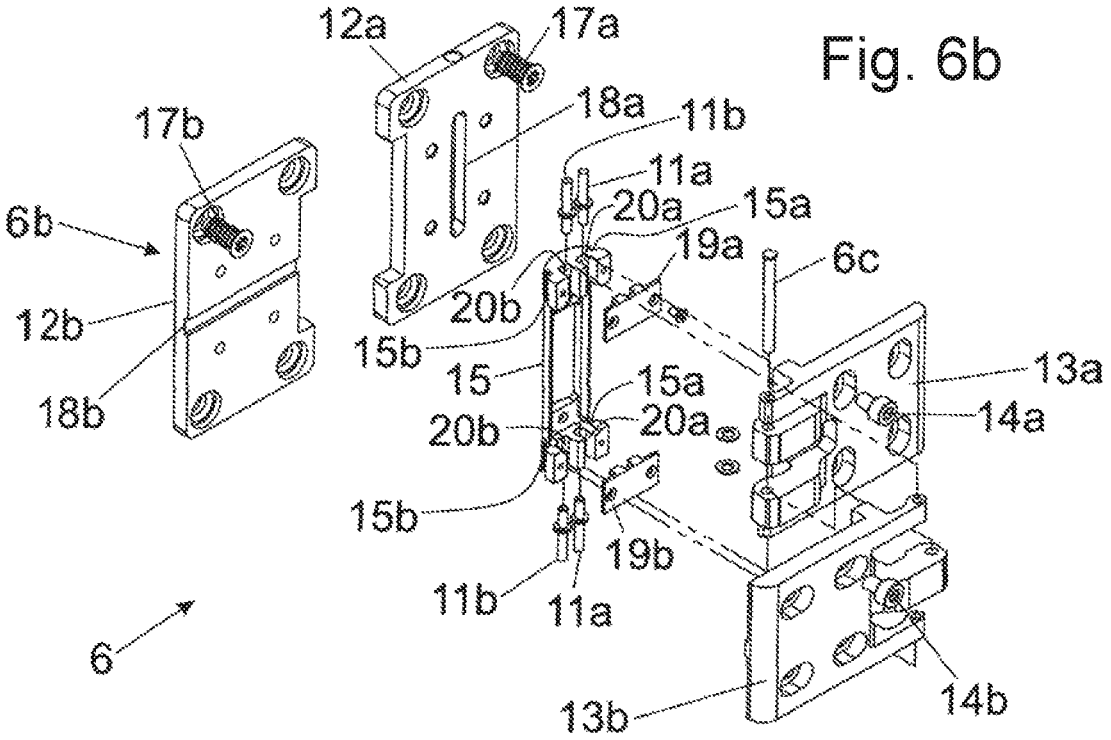

FIG. 6*b* shows the furniture hinge 6 in an exploded view. At least one first linear guide 18*a* is provided on the first base plate 12*a* of the first fitting portion 6*a* for the adjustable support of the first adjusting plate 13*a* in a direction (Y), while at least one second linear guide 18*b* is formed or arranged on the second base plate 12*b* of the second fitting portion 6*b* for the adjustable support of the second adjusting plate 13*b*. The bearing body 15 has upper and lower recesses 20*a* and 20*b* in which the upper and lower guide pins 11*a*, 11*b* of the adjusting plates 13*a*, 13*b* are guided with clearance. In order to cover the upper and lower recesses 20*a*, 20*b*, upper and lower cover plates 19*a*, 19*b* are provided configured to be fixed to the bearing body 15 by screws.

In contrast to the shown figures, the cover portion 5 can not only be provided for covering a vertically extending gap 31, but also for covering a horizontally extending gap 31, and the second furniture part 3*b* is pivotally supported relative to the first furniture part 3*a* about a horizontally extending axis.

The invention claimed is:

1. An item of furniture comprising:

a first furniture part;

a second furniture part; and furniture hinges by which the first furniture part and the second furniture part are pivotally connected to each other, wherein:

the furniture hinges are spaced apart from each other along a longitudinal direction of the first furniture part and the second furniture part, and a gap is defined between the first furniture part and the second furniture part;

a cover portion extends at least between the furniture hinges, and is configured to at least partially cover the gap;

the furniture hinges are configured to move the first furniture part and the second furniture part into a position in which the first furniture part and the second furniture part are aligned so as to be substantially coplanar relative to each other;

the cover portion is configured to be substantially covered by the first furniture part and/or by the second furniture part, in the position in which the first furniture part and the second furniture part are aligned so as to be substantially coplanar relative to each other;

one of the furniture hinges has a first abutment surface for resting against the first furniture part and a second abutment surface for resting against the second furniture part; and the cover portion is configured to be set back in a direction into the item of furniture from the first abutment surface and the second abutment surface, in the position in which the first furniture part and the second furniture part are aligned so as to be substantially coplanar relative to each other.

2. The item of furniture according to claim 1, wherein:

the furniture hinges are further configured to move the first furniture part and the second furniture part into a position in which the first furniture part and the second furniture part are aligned so as to be substantially parallel to one another; and the cover portion is configured to be between the first furniture part and the second furniture part, in the position in which the first furniture part and the second furniture part are aligned so as to be substantially parallel to one another.

3. The item of furniture according to claim 2, wherein a width of the cover portion is smaller than a distance between the first abutment surface and the second abutment surface, in the position in which the first furniture part and the second furniture part are aligned so as to be substantially parallel to one another.

4. The item of furniture according to claim 2, wherein the cover portion is configured to protrude at least partially from the first furniture part and the second furniture part, in the position in which the first furniture part and the second furniture part are aligned so as to be substantially parallel to one another.

5. The item of furniture according to claim 1, wherein:

the one of the furniture hinges has a hinge axis; and a longitudinal direction of the cover portion extends substantially parallel to the hinge axis.

6. The item of furniture according to claim 1, wherein the cover portion is configured to be connected to the one of the furniture hinges.

7. The item of furniture according to claim 6, wherein the cover portion is configured to be releasably connected to the one of the furniture hinges.

8. The item of furniture according to claim 1, wherein the furniture hinges include three or more furniture hinges.

9. The item of furniture according to claim 1, wherein:

the one of the furniture hinges includes a first fitting portion fixed to the first furniture part and a second fitting portion fixed to the second furniture part; and the first fitting portion and the second fitting portion are pivotally supported relative to each other about a hinge axis of the one of the furniture hinges upon a relative movement of the first fitting portion and the second fitting portion to each other.

10. The item of furniture according to claim 9, wherein:

the cover portion is movably supported relative to the one of the furniture hinges; and a movement of the cover portion is coupled to the relative movement of the first fitting portion and the second fitting portion to each other.

11. The item of furniture according to claim 9, wherein the cover portion is configured to be symmetrically movable relative to the first furniture part and the second furniture part, upon the relative movement of the first fitting portion and the second fitting portion to each other.

12. An arrangement for an item of furniture which includes a first furniture part and a second furniture part, the arrangement comprising:

furniture hinges configured to pivotally connect the first furniture part and the second furniture part to each other; and a cover portion which extends at least between the furniture hinges, wherein:

the furniture hinges are configured to: (i) be spaced apart from each other along a longitudinal direction of the first furniture part and the second furniture part; (ii) at least partially cover a gap between the first furniture part and the second furniture part; and (iii) move the first furniture part and the second furniture part into a position in which the first furniture part and the second furniture part are aligned so as to be substantially coplanar relative to each other;

the cover portion is configured to be substantially covered by the first furniture part and/or by the second furniture part, in the position in which the first furniture part and the second furniture part are aligned so as to be substantially coplanar relative to each other;

one of the furniture hinges has a first abutment surface for resting against the first furniture part and a second abutment surface for resting against the second furniture part;

the cover portion is configured to be set back in a direction into the item of furniture from the first abutment surface and the second abutment surface, in the position in which the first furniture part and the second furniture part are aligned so as to be substantially coplanar relative to each other; and the cover portion is configured to be connected to the one of the furniture hinges.

13. The arrangement according to claim 12, wherein:

the one of the furniture hinges includes a first fitting portion configured to be fixed to the first furniture part and a second fitting portion configured to be fixed to the second furniture part; and the first fitting portion and the second fitting portion are pivotally connected to each other by a hinge axis.

14. The arrangement according to claim 13, wherein:

the one of the furniture hinges includes a bearing body which is configured to be connected to the cover portion;

the bearing body includes a first recess and a second recess; and a first guide pin of the first fitting portion is configured to be guided within the first recess with a first clearance and a second guide pin of the second fitting portion is configured to be guided within the second recess with a second clearance.

15. The arrangement according to claim 12, wherein the one of the furniture hinges includes a bearing body which is configured to be connected to the cover portion.

16. The arrangement according to claim 12, wherein the cover portion is configured as a profiled rail.

17. The arrangement according to claim 16, wherein the profiled rail is made of metal or plastic.

18. The arrangement according to claim 12, wherein the cover portion is configured to be releasably connected to the one of the furniture hinges.

* * * * *